US007373702B1

(12) United States Patent
Vonderheide

(10) Patent No.: US 7,373,702 B1
(45) Date of Patent: May 20, 2008

(54) TREE MOUNTED CREMATION ASH URN

(76) Inventor: Gregory J. Vonderheide, 29032 Rivergate Run, Wesley Chapel, FL (US) 33543-6544

( * ) Notice: Subject to any disclaimer, the term of this patent is extended or adjusted under 35 U.S.C. 154(b) by 0 days.

(21) Appl. No.: 11/754,008

(22) Filed: May 25, 2007

(51) Int. Cl.
*A61G 17/00* (2006.01)

(52) U.S. Cl. ..... 27/1

(58) Field of Classification Search ..... 27/1; D99/5; 47/1.01 R
See application file for complete search history.

(56) References Cited

U.S. PATENT DOCUMENTS 4,977,652 A * 12/1990 Graham ..... 27/1
5,799,488 A * 9/1998 Truong ..... 47/1.01 R
5,815,897 A * 10/1998 Longstreth ..... 27/1
5,903,961 A * 5/1999 Parker et al. ..... 27/1
6,516,501 B2 * 2/2003 Vazquez-Perez ..... 27/1
7,272,874 B2 * 9/2007 Staab ..... 27/1
2003/0066172 A1 * 4/2003 Parker ..... 27/1

* cited by examiner

*Primary Examiner*—William L. Miller
(74) *Attorney, Agent, or Firm*—Ashley J. Wells

(57) ABSTRACT

A cremation container designed to be mounted on a living tree includes an inner chamber for cremation ashes therein, a front face having a first opening on the top in communication with the inner chamber. The opening is for insertion of the cremation ashes in the inner chamber as well a memorial time capsule of remembrances of the deceased. The container further includes mounting features for mounting the container to a living tree.

15 Claims, 2 Drawing Sheets

TREE MOUNTED CREMATION ASH URN

BACKGROUND OF THE INVENTION

1. Field of the Invention

The present invention relates generally to funeral products, and more particularly, to cremation containers for memorializing one whose cremated remains are contained therein.

2. Background of the Related Art

Upon the death of a loved one, it is often desired to memorialize the deceased's life in some personal manner. When making funeral arrangements, families typically have many options for services and memorials. In making such arrangements, it is generally desired to create a farewell event and memorial that is meaningful for those who will participate and to establish a permanent memorial to the deceased.

Cremation has become a growing segment of the funeral industry. Upon cremation, a deceased's remains are typically contained in some form of cremation container. Some desire to have the deceased's ashes stored in a suitable permanent container, such as an urn that may be displayed in the home or in another personal setting. Even where the deceased ashes are scattered, it is often desired to retain and display the scattering container, for example, on a fireplace mantel, coffee table, end table or the like, as a means for memorializing a loved one.

Accordingly, there is a demand for more options and higher quality styles and designs of cremation containers. One popular design theme for cremation urns is the outdoor or animal theme, considering that one of the most common places for scattering ashes is the backyard or garden. In this regard, there have been proposed various attractive means for displaying cremation containers.

For example, U.S. Pat. No. 20060168786 to Staab discloses a cremation container in the form of a birdhouse. The combination container has a first use for storing the ashes of a deceased and a separate second use as a birdhouse.

U.S. Pat. No. 6,175,995 to Parker et al. and U.S. Pat. No. D444,933 to Parker show various cremation containers in the forms of lawn and garden ornaments. Specifically, these patents show decorative structures such as sun dials, planters, wind chimes and bird baths that all have an inner compartment for maintaining and securing the ashes of a deceased in a permanent manner.

However, it has been heretofore unknown to provide a cremation container in the form of a tree mounted memorial urn and, more particularly, to provide a cremation container that can be easily and permanently mounted to a living tree.

Accordingly, it would be desirable to provide such an alternative means of memorializing a loved one who has been cremated, as an alternative to the conventional types of cremation containers presently available.

SUMMARY OF THE INVENTION

The present invention is a cremation container that is able to be permanently and securely mounted to a living tree. The container generally includes an inner chamber for storing cremation ashes therein. The top opening is for insertion of the cremation ashes in the inner chamber. The container further includes a curved mounting structure and straps for mounting the memorial cremation urn to a living tree.

In a preferred embodiment, the container further includes a front surface having a name inscribed thereon, a lid on the top for opening and closing the first opening and a back face opposite the front face having a curved mounting structure and straps for mounting the container to a living tree. The lid or door may be a locking door for securing the lid or door in a closed position. Also, the container may include a sealable container disposed in the inner chamber for permanently storing cremation ashes therein.

The present invention further involves a method for memorializing a loved one who has been cremated. The method generally includes the steps of storing the loved one's cremated ashes in a container, mounting the container to a living memorial tree and displaying the container in a manner wherein the loved one will be remembered upon viewing the tree. Preferably, the loved one's name is inscribed on the container. The loved one's cremation ashes may be permanently stored and displayed and memorialized, wherein a sealable container for storing the cremation ashes is placed in an inner chamber of the cremation container.

These and other objects, features, and advantages of this invention will become apparent from the following detailed description of illustrative embodiments thereof, which is to be read in connection with the accompanying drawings.

DETAILED DESCRIPTION OF THE INVENTION

Figure 1:
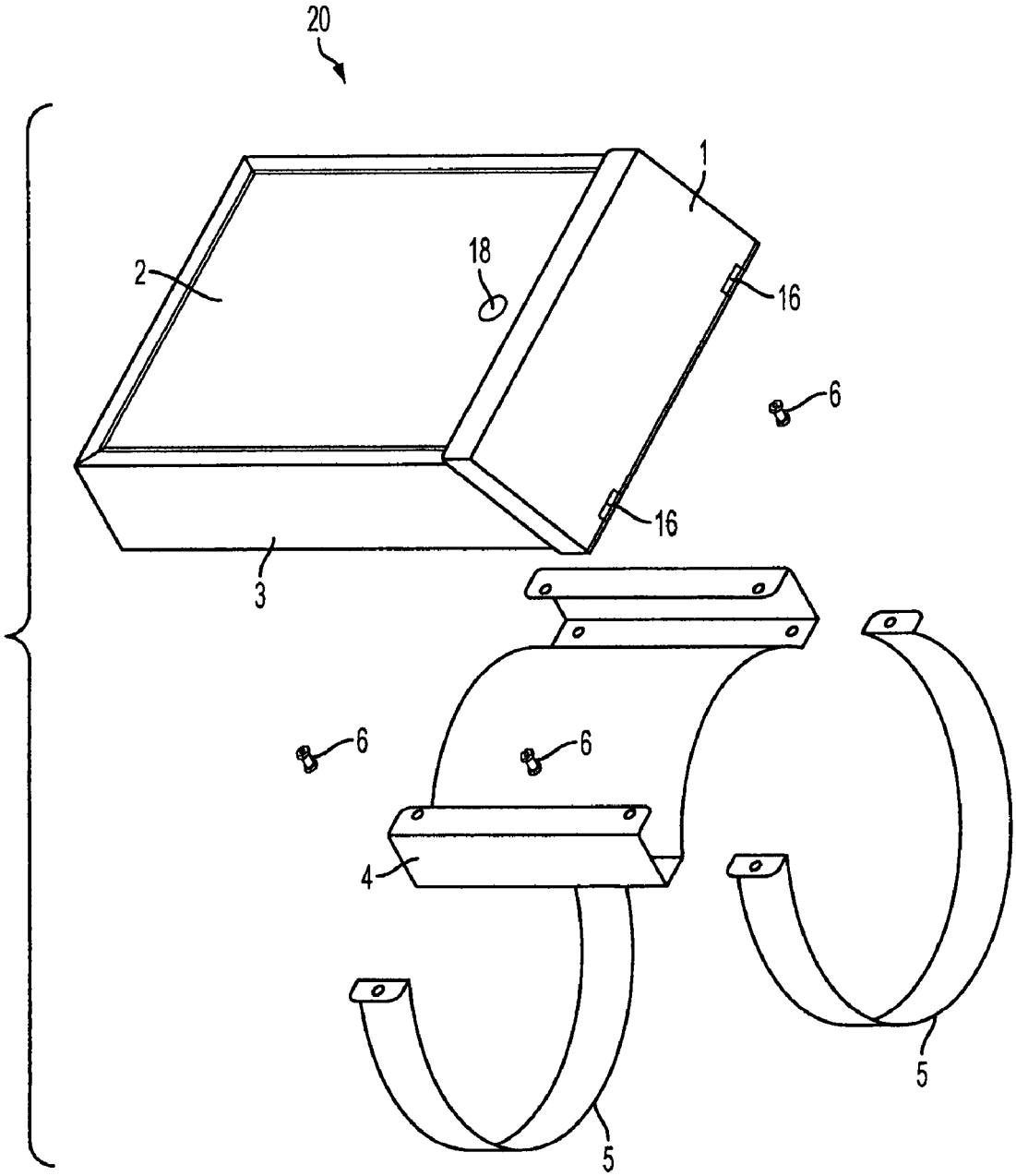
FIG. 1 is a perspective view of an exploded tree mountable cremation container formed in accordance with the present invention.
Figure 2A:
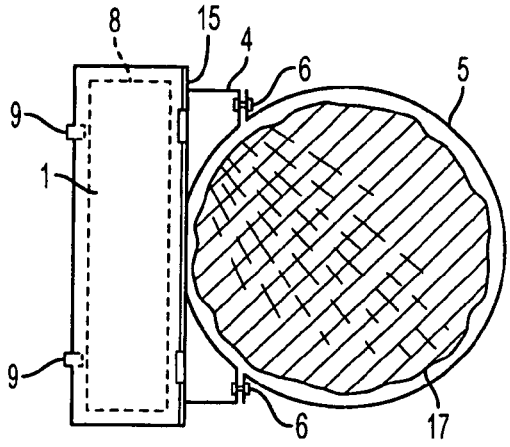
FIG. 2A is a top view of the tree mountable cremation container shown in FIG. 1.
Figure 2B:
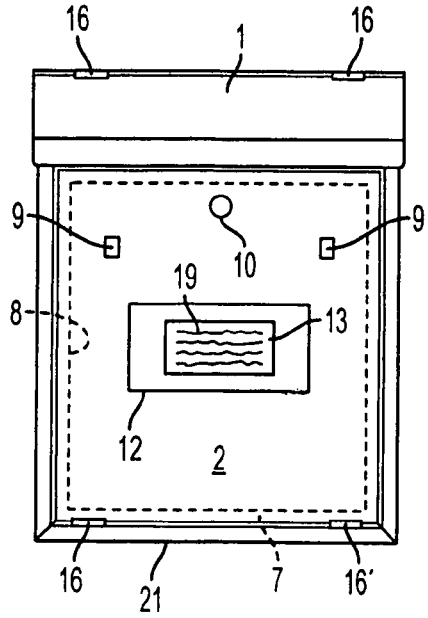
FIG. 2B is a front view of the tree mountable cremation container shown in FIG. 1.
Figure 3:
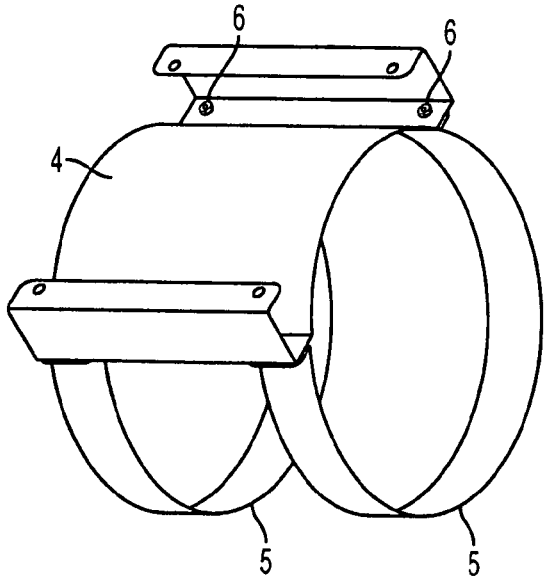
FIG. 3 is a perspective view of the mounting assemble used to attach the tree mountable cremation container shown in FIG. 1.

Referring first to FIGS. 1-3, a tree mountable cremation container or kit 20 generally includes a cremation container 20 with a front plate or door 2, lid or top 1, hinges 16,16', two sides 3, a back plate 15, a bottom 21, a tree mount bracket 4 and bolts 6 and two straps 5. The cremation container 20 is generally in the form of a cremation cabinet or urn known in the art. In particular, the cremation container 20 defines an inner chamber 7 for storing cremated ashes of a deceased therein.

The cremation container 20 may serve to permanently store a deceased's ashes. In this case, it is preferred to provide a sealable container 8 disposed within the inner chamber 7 of the tree mounted cremation ash urn, as shown in FIG. 1. A latch 18 or lock 10 may be provided. The sealable container 8 can be smaller than the inner chamber 7 and may be in the form of a capped tube, a plastic bag, a box, or in any other form that can safely isolate the ashes from the remainder of the inner chamber 7. Moreover, the sealable container may be retained against an inner wall of the inner chamber 7 by a bracket or clip 9 shown in FIGS. 2A and 2B, or by any other form of retaining structure. Again, the purpose of the sealable container is to maintain the deceased ashes sealed and apart from the remainder of the interior chamber 7.

The tree mounted cremation container 20 is further provided with a mounting structure 4, 5, 6 for attaching the container 20 to the living tree 17 shown in FIGS. 2A and 3. In a preferred embodiment, the mounting structure 4, 5, 6 is in the form of a curved mounting bracket 4, four mounting bolts 6 and two mounting straps 5.

At least one of the surfaces of the container 20, preferably the front plate 2, includes an outer structure 12 such as a surface or a placard or plaque defining a surface 13 upon which biographical information 19 concerning the deceased may be attached, inscribed or engraved. Such biographical information 19 may include the deceased's name, date of birth, date of death, surviving family, etc. The purpose of the outer structure 12 such as the surface, placard or plaque is to provide a visual remembrance or memorial of the deceased upon viewing the cremation container 20. It is noted that the terms "deceased" and "loved one," as used herein, may refer not only to persons, but also to pets or other animals.

A method for memorializing a deceased who has been cremated comprising the steps of: storing the deceased's cremated ashes in a container permanently attached to a tree; said secure container containing ashes and memorial items of the deceased; and displaying said container in a manner wherein the loved one will be remembered upon viewing said tree. A method as defined above further comprising the step of inscribing biographical information concerning the deceased on said container. A method as defined above further comprising the step of placing a sealable container for storing cremation ashes therein in said inner chamber of the cremation container. A method for memorializing a deceased who has been cremated comprising the steps of: storing the deceased's cremated ashes in a container and mounting and displaying said container in a manner wherein the deceased will be remembered upon viewing said living tree mounted cremation ash container.

A kit as defined above in the method, wherein said container further includes a surface having biographical information inscribed thereon. A kit as defined above in the method, wherein said container further includes a door for opening and closing said container. A kit as defined above, wherein said door is a locking door. A kit as above, wherein said door includes a latch for securing said door in a closed position. A kit as above in the method, wherein said back structure includes a curved surface that is sized to be fit on said tree and mounting straps. A kit as above in the method, wherein said container further includes a back surface opposite said first opening, said back surface including a curved mounting structure and straps for mounting said container to a tree. A kit as above in the method, further comprising a sealable container disposed in said inner chamber for storing cremation ashes therein.

A cremation container to be permanently attached and mounted on a living tree, said container comprising: an inner chamber for storing cremation ashes therein; a front face having a first opening in communication with said inner chamber, said first opening being sized for insertion of the cremation ashes in said inner chamber; a top mounted hinged lid with locking mechanism; and curved mounting structure and straps for mounting the container to the tree. A tree mounted cremation container as defined above in the method, further comprising a surface having biographical information inscribed thereon. A cremation container as defined above in the method, further comprising a door on said top for opening and closing said container. A cremation container as defined above in the method, wherein said door is a locking door. A cremation container as defined above in the method, wherein said door includes a lock for securing said door in a closed position. A cremation container as defined above in the method, further comprising mounting structure and straps for mounting said container to a natural living and growing tree. A cremation container as defined above in the method, further comprising a sealable container disposed in said inner chamber for storing cremation ashes therein. A tree mountable cremation container comprising: an outer structure having at least one side wall, a front, a back and a lid defining an inner chamber, and having at least one sealable container disposed in said inner chamber for storing cremation ashes therein. A tree mountable cremation container as defined above in the method, wherein said outer structure includes a surface having biographical information inscribed thereon and a mounting bracket. A cremation container as defined above in the method, wherein said outer structure includes a back surface opposite said front surface, said back surface including an attached and curved mounting structure and straps for mounting said structure to a living tree.

What is claimed is:

1. A method for memorializing a deceased who has been cremated and cremation ashes produced using a cremation ash container which is tree-mounted and dedicated to this use exclusively, the method comprising the steps of:

providing the cremation ash container to be securely mounted on a tree;

storing the deceased's cremation ashes and optionally memorial items of the deceased in the cremation ash container;

securing the cremation ash container with at least one of a locking mechanism a latch to secure the deceased's cremation ashes therein and prevent intrusion into the cremation ash container; and mounting the cremation ash container on the tree using a pair of straps for display and remembrance of the deceased.

2. The method according to claim 1, further comprising the step of inscribing biographical information concerning the deceased on the cremation ash container.

3. The method according to claim 1, further comprising the steps of, prior to the step of storing, placing the deceased's cremated ashes and optionally memorial items of the deceased in a sealable container which is separate from the cremation ash container; and sealing the sealable container.

4. A cremation ash container for containing cremation ash of a deceased and for permanent mounting on a living tree, the cremation ash container comprising:

a front plate;

a back plate;

a pair of side members connecting the front plate and the back plate, and defining there between an inner chamber in which the cremation ash and optionally memorial items of the deceased are placed in use;

a lid which is positioned on top of the front plate, the back plate and the pair of side members, which articulates around at least one hinge provided between the back plate and the lid, and which is provided with at least one of a latch and a locking mechanism;

a bottom attached beneath the front plate, the back plate and the pair of sides;

a tree mounting bracket which is externally attached to the back plate and which is curved to accommodate the living tree in use; and a pair of straps having ends which are attached to the tree mounting bracket and which surround the living tree in use.

5. The cremation ash container according to claim 4, further comprising a sealable container which contains the cremation ash and optionally memorial items of the deceased in use, which is sealed in use, and which is disposed within the inner chamber of the cremation ash container.

6. The cremation ash container according to claim 4, wherein the front plate has an external surface on which is inscribed biographical information about the deceased.

7. The cremation ash container according to claim 4, wherein the front plate has an external surface onto which a plate is attached that has thereon inscribed biographical information about the deceased.

8. A kit for a cremation ash container for containing cremation ash of a deceased and for permanent mounting on a living tree in use, the kit comprising:

a front plate;

a back plate;

a pair of side members for connecting the front plate and the back plate, and for defining there between an inner chamber in which cremation ash and optionally memorial items of the deceased are placed in use;

a lid for positioning on top of the front plate, the back plate and the pair of side members;

at least one hinge for attachment between the back plate and the lid to enable the lid to articulate and open around the at least one hinge;

at least one of a latch and a locking mechanism for securing the lid in place;

a bottom for attachment beneath the front plate, the back plate and the pair of sides, wherein the front plate, the back plate, the pair of sides, the lid, and the bottom cooperate to define the cremation ash container;

a plurality of bolts;

a tree mounting bracket which is curved to accommodate a living tree in use and which is to be externally attached to the back plate using the plurality of bolts; and a pair of straps which surround the living tree in use and which have ends which are attached to the tree mounting bracket using the plurality of bolts in use.

9. The kit according to claim 8, further comprising a sealable container which contains the cremation ash and optionally memorial items of the deceased in use, which is sealed in use, and which is disposed within the inner chamber of the cremation ash container.

10. The kit according to claim 8, wherein the front plate has an external surface on which biographical information about the deceased is inscribed in use.

11. The kit according to claim 8, further comprising a plate having a surface on which biographical information about the deceased is inscribed in use, and which is attached to an external surface of the front plate in use.

12. The kit according to claim 8, wherein the tree mounting bracket and pair of straps have sizes which fit on the living tree.

13. The kit according to claim 8, further comprising a sealable container for placing the cremation ash and optionally memorial items of the deceased in use and for placement within the inner chamber.

14. The kit according to claim 8, wherein the front plate is a door for opening and closing the cremation ash container in cooperation with the lid, and wherein the kit further comprises at least one hinge for attachment between the front plate and the bottom to enable the front plate to articulate and open around the at least one hinge.

15. The kit according to claim 14, wherein the at least one of a latch and a locking mechanism for securing the lid in place additionally functions to the door to secure the door in a closed position in use.

* * * * *